United States Patent [19]

Van Steenhoven

[11] 3,950,639

[45] Apr. 13, 1976

[54] HIGH BEAM LOW BRIGHTNESS LUMINAIRE

[75] Inventor: Frank Van Steenhoven, Peninsula, Ohio

[73] Assignee: Westinghouse Electric Corporation, Pittsburgh, Pa.

[22] Filed: Oct. 16, 1974

[21] Appl. No.: 515,392

[52] U.S. Cl. ..... 240/92; 240/25; 240/100; 240/106 R; 240/106.1; 240/125; 240/149; 240/150

[51] Int. Cl.[2] ..... F21V 13/00; F21V 5/04

[58] Field of Search ..... 240/25, 84, 92, 100, 106, 240/106.1, 125, 149, 150

[56] References Cited

UNITED STATES PATENTS

| | | | |
|---|---|---|---|
| 1,321,023 | 11/1919 | Framburg | 240/125 |
| 1,358,131 | 11/1920 | Yardley | 240/100 |
| 2,786,936 | 3/1957 | Appleton | 240/125 |

*Primary Examiner*—L. T. Hix
*Assistant Examiner*—Russell E. Adams, Jr.
*Attorney, Agent, or Firm*—B. R. Studebaker

[57] ABSTRACT

A high beam, low brightness luminaire including an inverted dish-shaped housing of a frustoconical configuration terminating in an annular peripheral edge at its larger end. A generally frustoconical translucent refractor is secured to the annular peripheral edge of the housing at its larger end and an inwardly directed annular flange on the smaller end provides the sole support for a bowl-shaped, transparent, prismatic refractor which hangs therefrom. The normally open bottom of the bowl-shaped refractor may be closed off by a disc-shaped translucent diffusing refractor to complete the sealed optical system.

8 Claims, 5 Drawing Figures

HIGH BEAM LOW BRIGHTNESS LUMINAIRE

BACKGROUND OF THE INVENTION

With the advent of a new as well as continuing pressures for improved environmental conditions in manufacturing and production facilities, lighting levels in those facilities have become of increasing importance. In addition, energy conservaion considerations have made it apparent that the use of high pressure mercury and sodium vapor light sources provide the best solution to both of these problems. The energy conservation considerations go beyond merely the manufacturing and production facilities and extend into commercial applications such as supermarkets and other retail outlets. The high pressure mercury or sodium vapor lamps can produce high illumination levels while consuming considerably less power. Although these light sources in the past have been used in manufacturing facilities in the form of high-bay luminaires of the industrial type, these fixtures left considerably to be desired in terms of esthetic appearance as well as the mounting heights at which they could be effectively employed. A need clearly exists for a high pressure mercury of sodium vapor luminaire for use in industrial and commercial applications wherein, in addition to having an esthetically pleasing appearance, a high beam spread can be provided to permit significantly lower mounting heights for the luminaire. Of course, beam spreading prisms can be employed in connection with a luminaire housing such as illustrated in design U.S. Pat. Nos. 205,411 and 229,090 or 179,339. One significant problem that these kinds of luminaires provide is at low mounting heights the user of the illumination is subjected to a brightness effect caused by the significant contrast between the transparent prismatic refractor and the totally opaque luminaire housing. The subconscious effect of this contrast in terms of the apparent brightness of the luminaire provides a comparatively unsatisfactory environment for those persons who must work or shop under these conditions.

SUMMARY OF THE INVENTION

The high beam, low brightness luminaire of this invention provides an esthetically pleasing appearance in a commercial or industrial luminaire which has the facility to be mounted at comparatively low mounting heights while providing high angle beam distribution but eliminating brightness problems inherent in these kinds of luminaires mounted at comparatively low mounting heights.

The foregoing is accomplished in accordance with the present invention by providing in intermediate diffusing refractor between the luminaire housing and the prismatic beam distributing refractor and by employing a novel method for supporting the prismatic refractor from the interposed translucent diffusing refractor.

In accordance with the present invention, a luminaire is provided which comprises a generally frustoconical housing adapted to be mounted centrally at its narrower end and terminating in an annular peripheral edge at its larger end. A generally frustoconical translucent refractor is secured at its larger diameter end to the annular peripheral edge of the housing with the smaller diameter end of the translucent refractor terminating in an inwardly directed flange. A generally bowl-shaped, open bottom, transparent, prismatic refractor is mounted below the translucent refractor and supported thereby. The transparent bowl-shaped refractor includes an annular outwardly directed flange at its upper edge which is constructed and arranged to overlie the inwardly directed flange on the translucent refractor to thereby retain and support the transparent prismatic refractor with respect to the housing through the translucent refractor. The bottom end of the bowl-shaped, transparent, prismatic refractor may be closed off by a disc-shaped, translucent refractor and an annular filter seal may be interposed between the annular peripheral edge of the housing and the large diameter end of the generally frustoconical translucent refractor to provide a fully enclosed and sealed optical system where desired.

BRIEF DESCRIPTION OF THE DRAWINGS

Many of the attendant advantages of the present invention will become more readily apparent and better understood as the following detailed description of an exemplary embodiment is considered in connection with the accompanying drawings in which.

DESCRIPTION OF THE PREFERRED EMBODIMENTS

Figure 1:
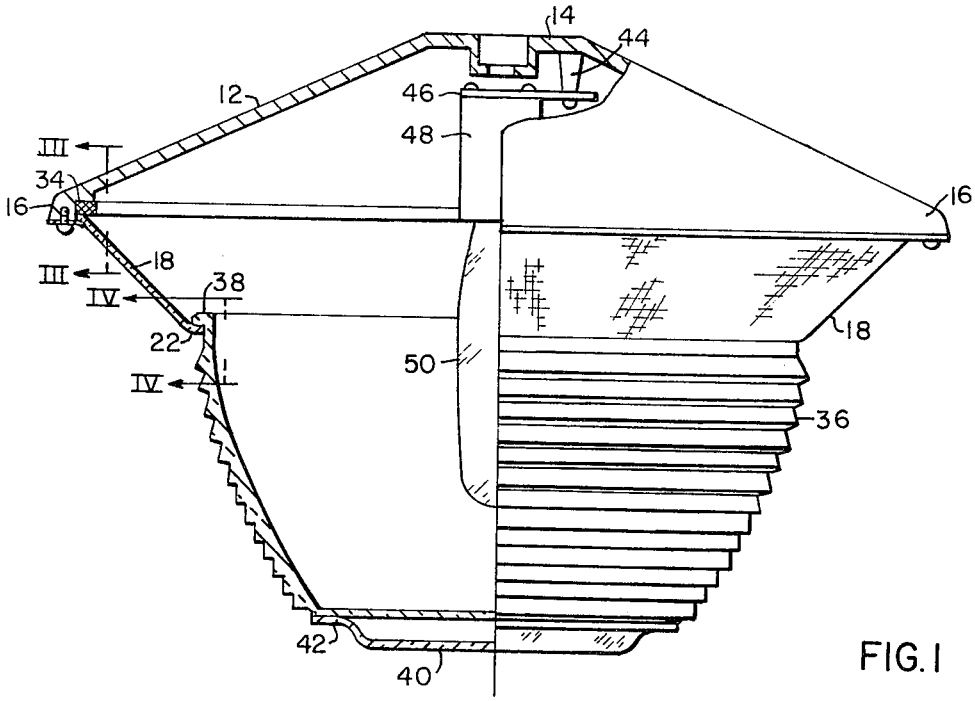
FIG. 1 is a side elevational view partly in section of the luminaire of this invention.
Figure 2:
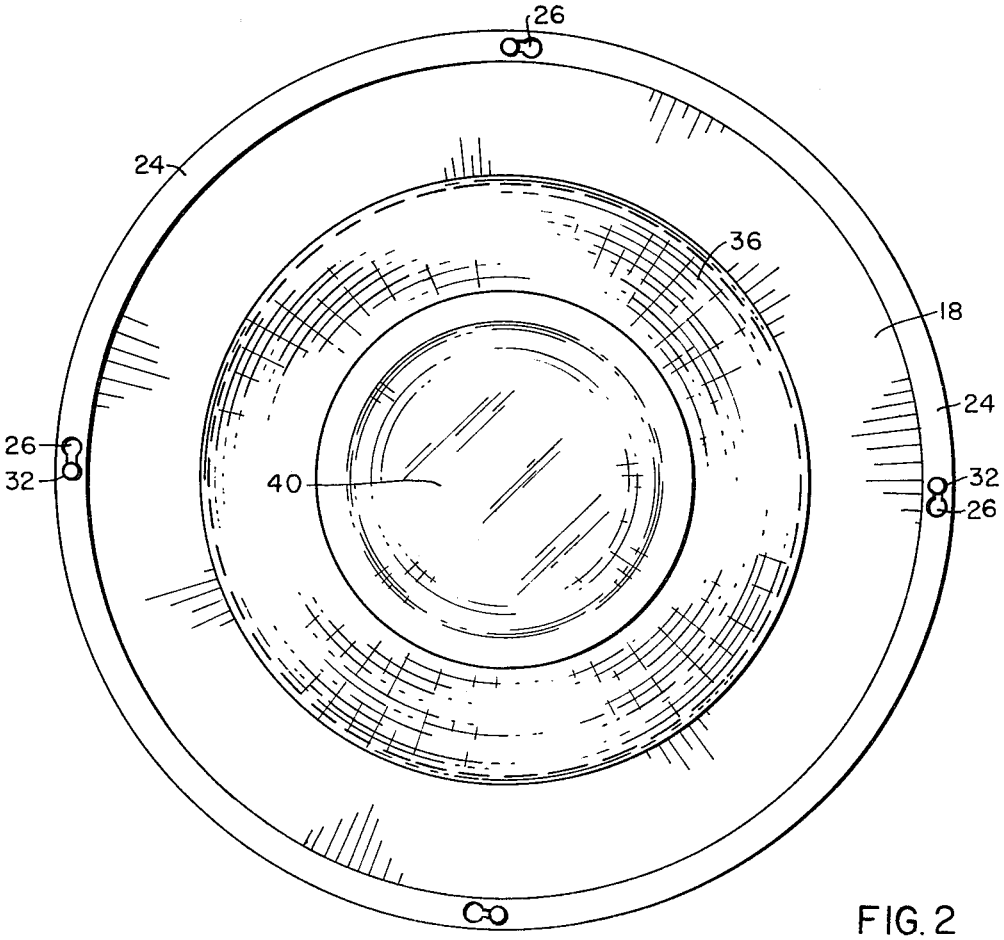
FIG. 2 is a bottom plan view of the luminaire of FIG. 1.
Figure 3:
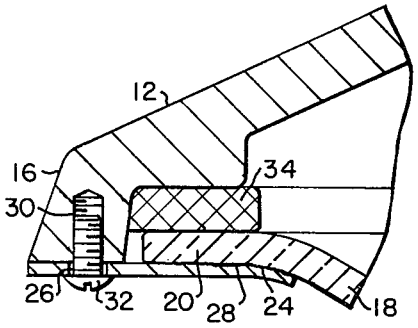
FIG. 3 is an enlarged view of the area III—III of FIG. 1.
Figure 4:
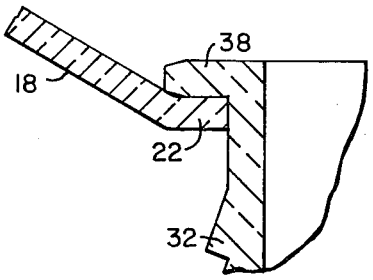
FIG. 4 is an enlarged view of the area IV—IV of FIG. 1.
Figure 5:
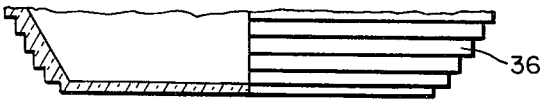
FIG. 5 is a partial side-elevational view partly in section of a modified refractor for the luminaire of FIG. 1.

Referring now in detail to the drawings wherein like reference characters represent like parts throughout the several views, there is illustrated in FIG. 1 a high beam low brightness luminaire constructed in accordance with this invention. The luminaire includes a generally frustoconical or inverted dish-shaped housing 12 which has an opening 14 centrally located at the top thereof to facilitate the mounting of the luminaire and for providing electrical service of the luminaire. The housing terminates at its larger bottom end in an annular peripheral edge 16.

A downwardly and inwardly tapering generally frustoconical translucent refractor 18 having an outwardly extending annular flange 20 at its larger end and an inwardly extending annular flange 22 at its smaller end is secured to the annular peripheral edge 16 of the housing 12 by means of a metal ring 24 which includes a plurality of keyhole slots 26. The metal ring 26 is cemented to the translucent refractor 18 at 28 and extends outwardly of the flange 20 in order that the keyhole slots 26 overlie threaded apertures 30 in the annular peripheral edge 16 of the housing 12. A plurality of bolts 32 extending through the keyhole slots 26 secure the translucent refractor 18 to the housing 12. If a sealed optical system is desired, an annular dacron polyester filter seal 34 may be interposed between the flange 20 of the refractor 18 and the annular peripheral edge 16 of the housing 12. The dacron polyester filter seal 34 will permit the luminaire to "breath" as the pressures vary due to the internal heating of the luminaire when the lamp is operated but will filter out dust particles and other airborne matter which could deposit on the internal surfaces of the optical system and reduce the luminaire efficiency.

Mounted beneath and suspended from the translucent refractor 18 is a generally bowl-shaped substantially transparent prismatic refractor 36. The refractor 36 includes at its upper end an annular outwardly extending flange 38 which is constructed and arranged to overlie the internally directed flange 22 of the translucent refractor 18 and the two refractors are preferably sealed and bonded together at their interface. The transparent prismatic bowl-shaped refractor 36 may be open at its bottom in the non-sealed optical system configuration or may be closed off by a disc-shaped translucent refractor 40 having a flange thereabout 42 which may be also sealed and bonded to the bottom edge of transparent refractor 36 when a sealed optical system is desired.

In order to mount a lamp within the luminaire housing so that it extends into the refractor area a boss 44 is preferably cast to the luminaire housing 12 and has mounted thereon a socket mounting plate 46 to which a socket 48 is secured for mounting and retaining a discharge lamp 50 within the optical system.

The generally frustoconical or inverted dish-shaped housing 12 is preferably of cast aluminum but could be of spun or hydroformed metal. The housing could also include heat dissipating fins if such were desired and a ballast housing for operating the lamp may be secured directly to the luminaire mounting aperture 14. The translucent refractors 18 and 40 are preferably of white polycarbonate and the prismatic refractor 36 is preferably of clear polycarbonate which permits the sealing and bonding between the various refractors 18, 36 and 40 to be accomplished by use of silicone sealant adhesive or by means of a solvent as will be understood by those skilled in the art. Alternately, each of the refractors may also be acrylic or glass as dictated by the particular environment or use requirements.

Although translucent and transparent refractors have been used in combination in other type luminaires as for example the outdoor lighting fixture disclosed in U.S. Pat. No. 3,189,736 to W. M. Waldbauer, such use was primarily to provide diffused lighting to a reflector within the confines of that reflector. It will be readily apparent that the construction and attributes of the luminaire of this invention differ significantly from the prior art luminaires.

As will be apparent from the foregoing the luminaire of this invention provides for a multi-refractor optical system completely suspended from the luminaire housing. The interposition of the translucent refractor 18 between the housing 12 and the prismatic, transparent refractor 36 diminishes significantly the contrast and hence the brightness effect on people viewing the luminaire by providing a band of subdued or diffused light between the bright prismatic refractor and the comparatively dark or opaque luminaire housing. Additionally, a totally sealed optical system can be provided by the combination of the translucent diffusing refractor 40 closing off the open bottom of the transparent refractor 36 in combination with the dacron polyester filter seal 34 which is interposed at the junction of the housing 12 with the translucent refractor 18. The provison of spreading prisms on the prismatic refractor 36 provides a high beam angle for the principle light given off by the luminaire with the area beneath the luminaire, at steeper angles, being filled in by the diffused light emanating from both the diffusing, translucent refractor 40 and the frustoconical, diffusing, translucent refractor 18. The combination of these features provide a luminaire suitable for use at low mounting heights in both industrial and commercial environments which provides high beam spread and low brightness combined in an esthetically pleasing luminaire.

What is claimed is:

1. A luminaire comprising:

a generally frustoconical housing adapted to be mounted centrally at its narrower end and terminating in an annular peripheral edge at its larger end;

a generally frustoconical translucent refractor secured at its large diameter end to said annular peripheral edge of said housing, the smaller diameter end of said translucent refractor terminating in an inwardly directed flange; and a generally bowl-shaped open bottomed transparent refractor including an annular outwardly directed flange at its upper edge, said outwardly directed flange on said transparent refractor constructed and arranged to overlie said inwardly directed flange on said translucent refractor to thereby retain and support said transparent refractor with respect to said housing through said translucent refractor.

2. The luminaire according to claim 1 wherein said generally bowl-shaped transparent refractor is prismatic.

3. A luminaire comprising:

a generally frustoconical housing adapted to be mounted centrally at its narrower end and terminating in an annular peripheral edge at its larger end;

a generally frustoconical translucent refractor secured at its larger diameter end to said annular peripheral edge of said housing, the smaller diameter end of said translucent refractor terminating in an inwardly directed flange;

a generally bowl-shaped open bottomed transparent refractor including an annular outwardly directed flange at its upper edge, said outwardly directed flange on said transparent refractor constructed and arranged to overlie said inwardly directed flange on said translucent refractor to thereby retain and support said transparent refractor with respect to said housing through said translucent refractor;

a disc-shaped translucent refractor sealed to the bottom edge of said bowl-shaped transparent refractor closing off the open bottomed end thereof; and an annular filter seal interposed between the annular peripheral edge of said housing and said larger diameter end of said generally frustoconical translucent refractor thereby providing a fully enclosed and sealed optical system.

4. The liminaire according to claim 3 wherein said generally frustoconical translucent refractor and said generally bowl-shaped transparent refractor are bonded together to form a seal at said flange.

5. A high beam, low brightness luminaire comprising:

an inverted dish-shaped opaque housing having an annular peripheral edge;

lamp socket means mounted centrally within said housing and extending downwardly from the interior thereof;

a first downwardly and inwardly tapering, translucent annular refractor having an inwardly directed flange at its lower edge and secured at its largest diameter to the annular peripheral edge of said dish-shaped housing; and a second, substantially transparent bowl-shaped refractor having at its upper end an outwardly directed flange constructed and arranged to overlie the inwardly directed flange on said translucent annular refractor to thereby support said transparent bowl-shaped refractor from said translucent annular refractor, whereby a visual transition zone is provided by said first translucent refractor between the opaque housing and the second substantially transparent bowl-shaped refractor.

6. The luminaire according to claim 5 wherein said substantially transparent, bowl-shaped refractor is prismatic.

7. The luminaire according to claim 5 wherein said inverted dish-shaped opaque housing is provided with a mounting and conduit entrance means centrally thereof.

8. The luminaire according to claim 5 wherein said translucent annular refractor and said substantially transparent bowl-shaped refractor are bonded together to form a seal at said flanges.

* * * * *